US006394757B1

(12) United States Patent
Lackey

(10) Patent No.: US 6,394,757 B1
(45) Date of Patent: May 28, 2002

(54) DOWNROD COVERINGS

(75) Inventor: Robert W. Lackey, Hickory, NC (US)

(73) Assignee: Prime Home Impressions, LLC, Coppell, TX (US)

( * ) Notice: Subject to any disclaimer, the term of this patent is extended or adjusted under 35 U.S.C. 154(b) by 0 days.

(21) Appl. No.: 09/643,585

(22) Filed: Aug. 22, 2000

(51) Int. Cl.[7] ..... F04D 29/60
(52) U.S. Cl. ..... 416/244 R; 416/210 R
(58) Field of Search ..... 416/244 R, 5, 416/246, 210 R; D23/385, 377

(56) References Cited

U.S. PATENT DOCUMENTS

| | | | | |
|---|---|---|---|---|
| 4,884,947 A | * | 12/1989 | Rezek | 416/5 |
| 5,507,619 A | | 4/1996 | Ryan | 416/5 |
| 5,658,129 A | | 8/1997 | Pearce | 416/5 |
| 5,883,449 A | | 3/1999 | Mehta et al. | 310/60 R |
| 5,899,663 A | | 5/1999 | Feder et al. | 416/5 |
| 5,944,487 A | | 8/1999 | Pearce | 416/244 R |
| 5,947,436 A | | 9/1999 | Bucher et al. | 248/345 |
| 5,951,253 A | | 9/1999 | Gajewski | 416/214 R |
| 5,988,580 A | | 11/1999 | Bucher et al. | 248/343 |
| 6,010,110 A | | 1/2000 | Bucher et al. | 248/694 |
| 6,017,190 A | | 1/2000 | Lackey | 416/244 R |
| 6,027,310 A | | 2/2000 | Kerr, Jr. et al. | 416/210 R |
| 6,036,154 A | | 3/2000 | Pearce | 248/343 |
| 6,046,416 A | | 4/2000 | Bucher et al. | 200/330 |
| 6,146,191 A | | 11/2000 | Kerr, Jr. et al. | 439/537 |
| 6,158,964 A | | 12/2000 | Gajewski | 416/244 R |
| 6,171,060 B1 | | 1/2001 | Gajewski | 416/244 R |
| 6,196,804 B1 | | 3/2001 | Lackey | 416/244 R |
| 6,199,813 B1 | * | 3/2001 | Oliva | 248/343 |
| 6,200,095 B1 | | 3/2001 | Bucher et al. | 416/5 |
| 6,204,461 B1 | | 3/2001 | Bucher et al. | 200/330 |
| 6,247,894 B1 | | 6/2001 | Moody et al. | 416/5 |
| 6,250,885 B1 | | 6/2001 | Gajewski | 416/214 R |

* cited by examiner

*Primary Examiner*—F. Daniel Lopez
*Assistant Examiner*—Richard Edgar
(74) *Attorney, Agent, or Firm*—John B. Hardaway, III; Nexsen Pruet Jacobs & Pollard, LLC

(57) ABSTRACT

A downrod of a ceiling fan is provided with a decorative covering which may be utilized for various sizes of downrods.

2 Claims, 2 Drawing Sheets

DOWNROD COVERINGS

This invention relates generally to the art of ceiling fans, and more particularly to decorative covering for functional features thereof.

BACKGROUND OF THE INVENTION

Overhead ceiling fans are generally mounted from a ceiling fixture to a fan motor with a downrod which extends vertically to a desirable elevation for placement of the ceiling fan. Such downrods are typically of functional metallic material such as galvanized iron and sometimes such metallic components contain decorative metallic coatings. Such downrods generally engage a ball structure within the ceiling fixture and a threaded receptacle within the motor housing. Such downrods are, simply put, metallic pipes with threads on each end to appropriately engage both the ceiling and the fan motor. The interior hollow of the interior downrods serves as a conduit for the passage of electrical connections between an electrical box in the ceiling and the fan motor. Such downrods are generally available in two sizes, i.e., ½" outer diameter and ¾" outer diameter.

Such downrods do not readily lend themselves to ornamentation or decoration beyond the stark natural metallic finishes.

SUMMARY OF THE INVENTION

It is thus an object of this invention to provide ornamentation for a downrod of a ceiling fan;

It is a further object of this invention to provide such ornamentation which is adaptable for diverse sizes of downrod diameters.

These as well as other objects are accomplished by a covering for a ceiling fan downrod having a collar for engagement with a ceiling fixture which encircles the downrod and matingly engages a cylindrical cover which surrounds the circumference of the downrod.

DETAILED DESCRIPTION

In accordance with this invention it has been found that stark metallic appearance of a ceiling fan downrod may be ornamentally and decoratively enhanced by the utilization of a covering which is capable of covering and ornamenting downrods of all sizes. Such coverings provide not only ornamentation but, in exterior environments, protection from weathering. Various other advantages and features will become apparent from the following detailed description, together with reference to the various figures of drawing.

Figure 1:
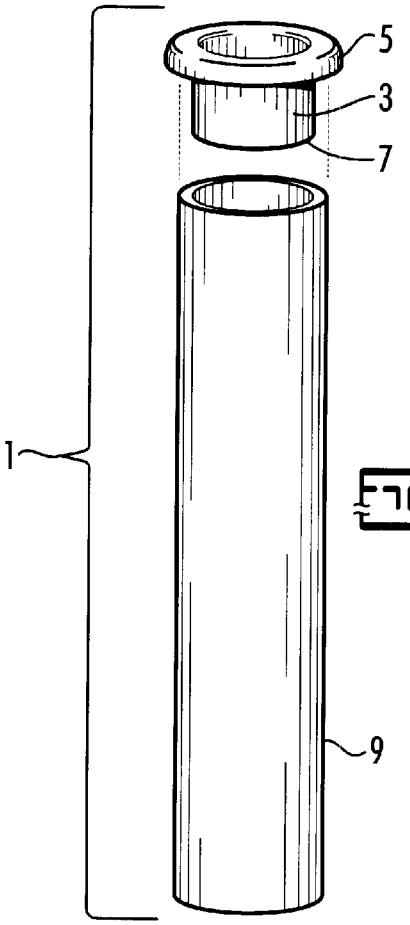
FIG. 1 is an assembly perspective view of the covering in accordance with this invention.

FIG. 1 illustrates an assembly perspective view, a covering 1 in accordance with this invention. Simply put, the covering comprises a generally cylindrical collar 3 which is rounded in its upper portion 5 to conform to a ceiling mounting. The lower portion of collar 3 tapers to a terminus 7 which is matingly engaged within a cylindrical cover 9.

Figure 2:
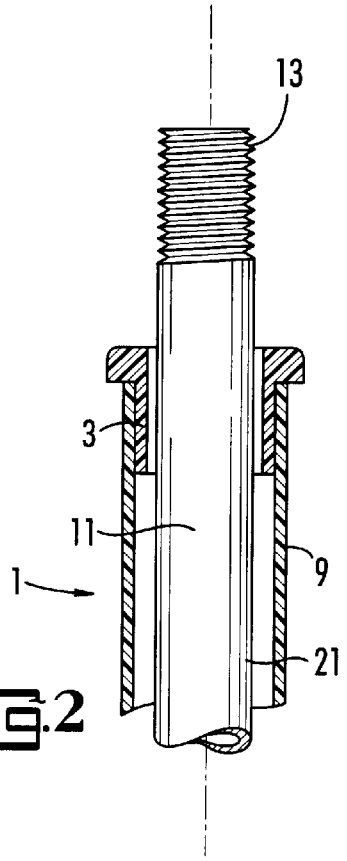
FIG. 2 is a sectional view of a covering in accordance with this invention.

FIG. 2 of the drawings illustrates the covering 1 with the collar 3 inserted therein and covering a downrod 11. It is, of course, understood that downrod 11 has threads 13 thereon for engagement with a ceiling ball joint not shown. It should be noted that there is a spacing 21 between downrod 11 and cover 9 as well as collar 3. The spacing is sufficient to house either a ½" downrod or a ¾" downrod. Typically a 1" outer diameter with a 1/16" wall is satisfactory for all purposes.

Figure 3:
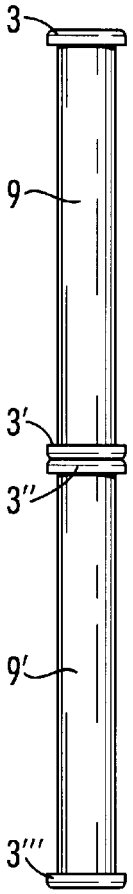
FIG. 3 is a perspective view of multiple sections of the covering of this invention.

FIG. 3 of the drawings illustrates how a plurality of covers 9 and 9' together with a plurality of collar 3, 3', 3", and 3'" may be stacked to provide an appropriate length from ceiling fixture to fan motor. It is understood that the cover of this invention may be cut to any desirable length with a collar inserted therein at the terminus. Optionally the collar may be omitted at the junction with the ceiling fan motor.

The embodiments illustrated in FIGS. 1 through 3 are adapted for assembly simultaneously with the assembly of a ceiling fan fixture such that collars and covers may be simply mounted about the downrod.

Figure 4:
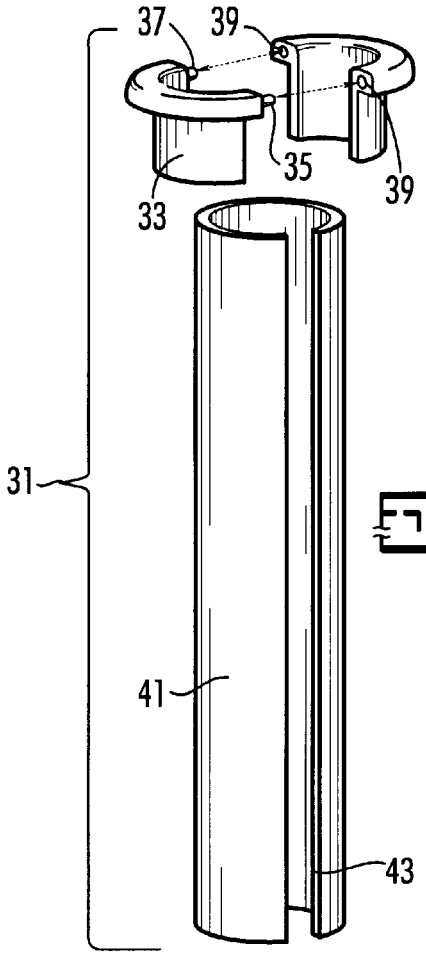
FIG. 4 is an assembly perspective view of another embodiment of this invention.

FIG. 4 of the drawings illustrates an embodiment wherein the covering 31 comprises a split ring collar ring 33 which may be snapped together about a downrod utilizing adjoining means in the form of snap posts 35 and 37 and complimentary receptacle 39.

Cover 41 in this embodiment is a split cylindrical ring which may be separated at opening 43 to engage a downrod. It is understood that the plastic material of the cover is elastically formed to permit insertion and then through its memory recovers to close the split 43 and thus hide the downrod from viewing.

Figure 5:
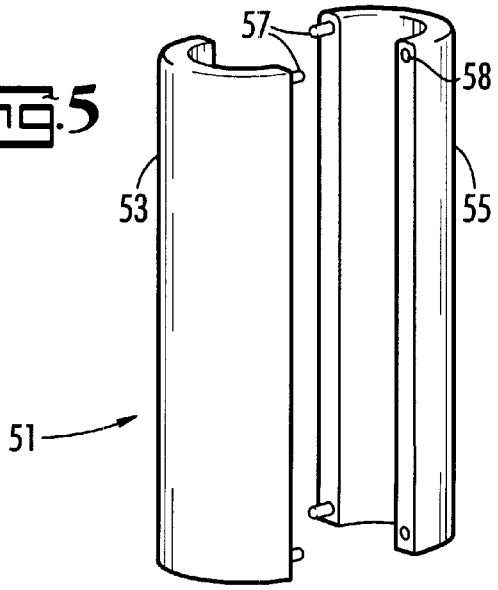
FIG. 5 is a two piece snap.

FIG. 5 of the drawings is yet another embodiment wherein a cover 51 may be matingly joined and snapped together by mating parts 53 and 55, having appropriate pegs 57 and a mating recess 58 to snap into position about a downrod. In a like manner, a collar such as that depicted at 33 in FIG. 4 may be utilized with this construction.

The downrod covers of this invention may be formed by molding or extrusion in any desirable color. The surface may be appropriately decorated, such as by embossing or vinyl or paper coating wrap. Likewise, they may be painted to match the decor of a room.

It is thus seen that this invention provides a novel covering for a ceiling fan downrod and provides such a cover which is versatile for all sizes of downrods.

As the above description is exemplary in nature many variations will become apparent to those with skill in the art.

Such variations however may be embodied within the spirit and scope of this invention as defined by the following appended claims.

What is claimed is:

1. A covering for a ceiling fan downrod, said downrod extending from a ceiling fixture, comprising:

a collar positionable adjacent said ceiling fixture encircling but spaced from said downrod;

a cylindrical cover beneath said collar encircling but spaced from said downrod;

said collar and said cover matingly engaged to surround said downrod; and stacked multiple sections of said collar and said cylindrical cover to surround a downrod.

2. A covering for a ceiling fan downrod, said downrod extending from a ceiling fixture, comprising:

a collar positionable adjacent said ceiling fixture encircling but spaced from said downrod;

a cylindrical cover beneath said collar encircling but spaced from said downrod;

said collar and said cover matingly engaged to surround said downrod; and said cover being split to permit elastic deformation thereof for placement about said downrod and elastic recovery therof to surround said downrod.

* * * * *